US008464788B2

(12) United States Patent
Stanford

(10) Patent No.: US 8,464,788 B2
(45) Date of Patent: Jun. 18, 2013

(54) HYDRAULIC DISCONNECT

(75) Inventor: Richard A. Stanford, Edmonton (CA)

(73) Assignee: E. Brace Tool Inc., Edmonton, Alberta (CA)

( * ) Notice: Subject to any disclaimer, the term of this patent is extended or adjusted under 35 U.S.C. 154(b) by 246 days.

(21) Appl. No.: 12/907,334

(22) Filed: Oct. 19, 2010

(65) Prior Publication Data

US 2012/0090849 A1 Apr. 19, 2012

(51) Int. Cl.
*E21B 17/06* (2006.01)

(52) U.S. Cl.
USPC ..... 166/242.6; 166/383

(58) Field of Classification Search
USPC ..... 166/323, 242.6, 380, 383
See application file for complete search history.

(56) References Cited

U.S. PATENT DOCUMENTS

| | | | | |
|---|---|---|---|---|
| 4,452,472 | A | 6/1984 | Crase | |
| 5,146,984 | A | 9/1992 | Pleasants | |
| 5,419,399 | A | 5/1995 | Smith | |
| 5,526,888 | A | 6/1996 | Gazewood | |
| 5,984,029 | A | 11/1999 | Griffin | |
| 6,053,262 | A | 4/2000 | Ferguson | |
| 6,131,953 | A | 10/2000 | Connell | |
| 6,425,443 | B1 | 7/2002 | Hill | |
| 6,557,637 | B1 | 5/2003 | Dore | |
| 6,808,023 | B2 | 10/2004 | Smith | |
| 6,923,256 | B2 | 8/2005 | Parker | |
| 7,040,406 | B2 | 5/2006 | Dore | |
| 7,234,527 | B2 | 6/2007 | Nivens | |
| 7,395,862 | B2 | 7/2008 | Ross | |
| 7,591,315 | B2 | 9/2009 | Dore | |
| 8,141,634 | B2 * | 3/2012 | Fisher et al. | 166/250.13 |
| 2004/0016544 | A1 * | 1/2004 | Braddick | 166/277 |
| 2008/0099210 | A1 | 5/2008 | Gazewood | |
| 2010/0084141 | A1 | 4/2010 | Gazewood | |

FOREIGN PATENT DOCUMENTS

| | | |
|---|---|---|
| CA | 2273607 | 12/1999 |
| CA | 2408807 | 11/2001 |
| CA | 2640180 | 4/2009 |

OTHER PUBLICATIONS

Coiled Tubing Rental Tools, Inc., "Assembly Manual: 2-⅛", Hydraulic Disconnect", at least as early as May 27, 2010.
Thru-Tubing Technology, A Division of Owen Oil Tools, "FDL Hydraulic Disconnect—TT0701", p. 15, at least as early as May 27, 2010.
Pedcor Inc., A Division of Gotco International, "Hydraulic Disconnect", http://www.pedcor.com/basic-coiled-tubing-tools/hydraulic_disconnect.html, at least as early as Feb. 18, 2010.
Schlumberger, excerpt from CoilTOOLS Catalog, Disconnect Tools, at least as early as May 27, 2010.
Venturi Oil Tools, LLC, 'Technical Brief for TJ Hydraulic Disconnect: 1.688" O.D. thru 2.875"', at least as early as 2008.
National-Oilwell Varco, L.P., "Technical Manual: PCE Coiled Tubing Motorhead Assembly", TM 210.1 C200-019-23 / 2.875", Revision B, at least as early as May 27, 2010.
Welltonic Ltd., 'Heavy Duty Latch Disconnect', at least as early as May 27, 2010.
Limar Oiltools Co., Ltd., "Hydraulic Disconnect", at least as early as May 27, 2010.
Champagne, 'Assembly: 1.687" OD "BMF" Hyd. Disconnect', Hunter Downhole Tools, at least as early as May 27, 2010.

* cited by examiner

*Primary Examiner* — Daniel P Stephenson
(74) *Attorney, Agent, or Firm* — Frank J. Dykas; Dykas & Shaver

(57) ABSTRACT

A hydraulic disconnect comprises: a downhole housing, an uphole housing, an inner mandrel, a piston, and a lock. The inner mandrel has a latch to restrict the downhole housing from relative downhole movement. The inner mandrel is connected for transmission of torque to the downhole housing. A piston is within the inner mandrel and has a latched position, and an unlatched position. The piston has a valve seat. The lock maintains the piston in the latched position, the lock being adapted to unlock in use upon receipt by the valve seat of a disconnect valve member and a predetermined hydraulic pressure. The uphole housing has a stop for restricting the downhole housing from relative uphole movement. The inner mandrel is threaded to the uphole housing and relative rotation between the uphole and the downhole housing tightens the downhole housing between the latch and the uphole housing.

14 Claims, 4 Drawing Sheets

HYDRAULIC DISCONNECT

TECHNICAL FIELD

This document relates to hydraulic disconnects.

BACKGROUND

Disconnect devices are used downhole to allow selective release of the portion of the tubing string positioned below the disconnect. A hydraulic disconnect is adapted to release upon application of a predetermined hydraulic pressure on a valve member in the disconnect, such as a drop ball received from uphole.

SUMMARY

A hydraulic disconnect is disclosed comprising: a downhole housing; an uphole housing; an inner mandrel at least partially disposed telescopically within the downhole housing, the inner mandrel having a latch extendable in a radially outward direction to latch against an inner shoulder of the downhole housing to restrict the downhole housing from relative downhole movement, the inner mandrel being connected for transmission of torque to the downhole housing; a piston at least partially disposed telescopically within the inner mandrel and having a latched position in which an outer surface of the piston is radially inward of the latch to maintain latching against the inner shoulder, and an unlatched position in which a groove in the outer surface is radially inward of the latch to allow radial contraction of the latch into the groove for release of the inner shoulder, the piston having a valve seat; and a lock for maintaining the piston in the latched position, the lock being adapted to unlock in use upon receipt by the valve seat of a disconnect valve member and application of a predetermined hydraulic pressure in a downhole direction against the disconnect valve member to allow the piston to move into the unlatched position; in which the uphole housing has a stop for restricting the downhole housing from relative uphole movement and the inner mandrel is threaded to the uphole housing such that relative rotation between the uphole housing and the downhole housing in use tightens the downhole housing between the latch and the uphole housing.

A hydraulic disconnect is also disclosed, comprising: a downhole housing; an uphole housing having an inner mandrel; the inner mandrel being at least partially disposed telescopically within the downhole housing, the inner mandrel having a latch extendable in a radially outward direction to latch against an inner shoulder of the downhole housing to restrict the downhole housing from relative downhole movement in use; a piston at least partially disposed telescopically within the inner mandrel and having a latched position in which an outer surface of the piston is radially inward of the latch to maintain latching against the inner shoulder, and an unlatched position in which a groove in the outer surface is radially inward of the latch to allow radial contraction of the latch into the groove for release of the inner shoulder, the piston having a valve seat; and a lock for maintaining the piston in the latched position, the lock being adapted to unlock in use upon receipt by the valve seat of a disconnect valve member and application of a predetermined hydraulic pressure in a downhole direction against the disconnect valve member to allow the piston to move into the unlatched position; in which the inner mandrel and the downhole housing comprise respective out-of-round convex cross-sectional profiles that mesh in use for transmission of torque.

These and other aspects of the device and method are set out in the claims, which are incorporated here by reference.

BRIEF DESCRIPTION OF THE FIGURES

Embodiments will now be described with reference to the figures, not drawn to scale, in which like reference characters denote like elements, by way of example, and in which.

DETAILED DESCRIPTION

Immaterial modifications may be made to the embodiments described here without departing from what is covered by the claims.

In the operation of oil and gas wells, it may be necessary to perform several downhole operations in the well. Thus, various types of operating tools have evolved to perform these various operations. Previously, wireline was used to connect the operating tools to equipment above ground and to lower, set and retrieve the operating tools into and from the well. More recently, coiled tubing and jointed tubing-based tools, that are able to be operated by manipulation of the tubing string without use of wireline, have been developed.

It is not an uncommon occurrence for the operator to wish to leave a tool in the well or for a tool to become stuck or jammed in the well. In either case, it may be necessary to disconnect the tubing from the tool so that the tubing can be removed from the well. The operating equipment may be subsequently fished out of the well. To accommodate disconnection, disconnect or emergency release devices have been developed. Such disconnects may be installed at a suitable location in the tubing, for example at or near the end of the tubing adjacent to the tool at the lower end of the tubing.

Figures 1, 2A, 2B:
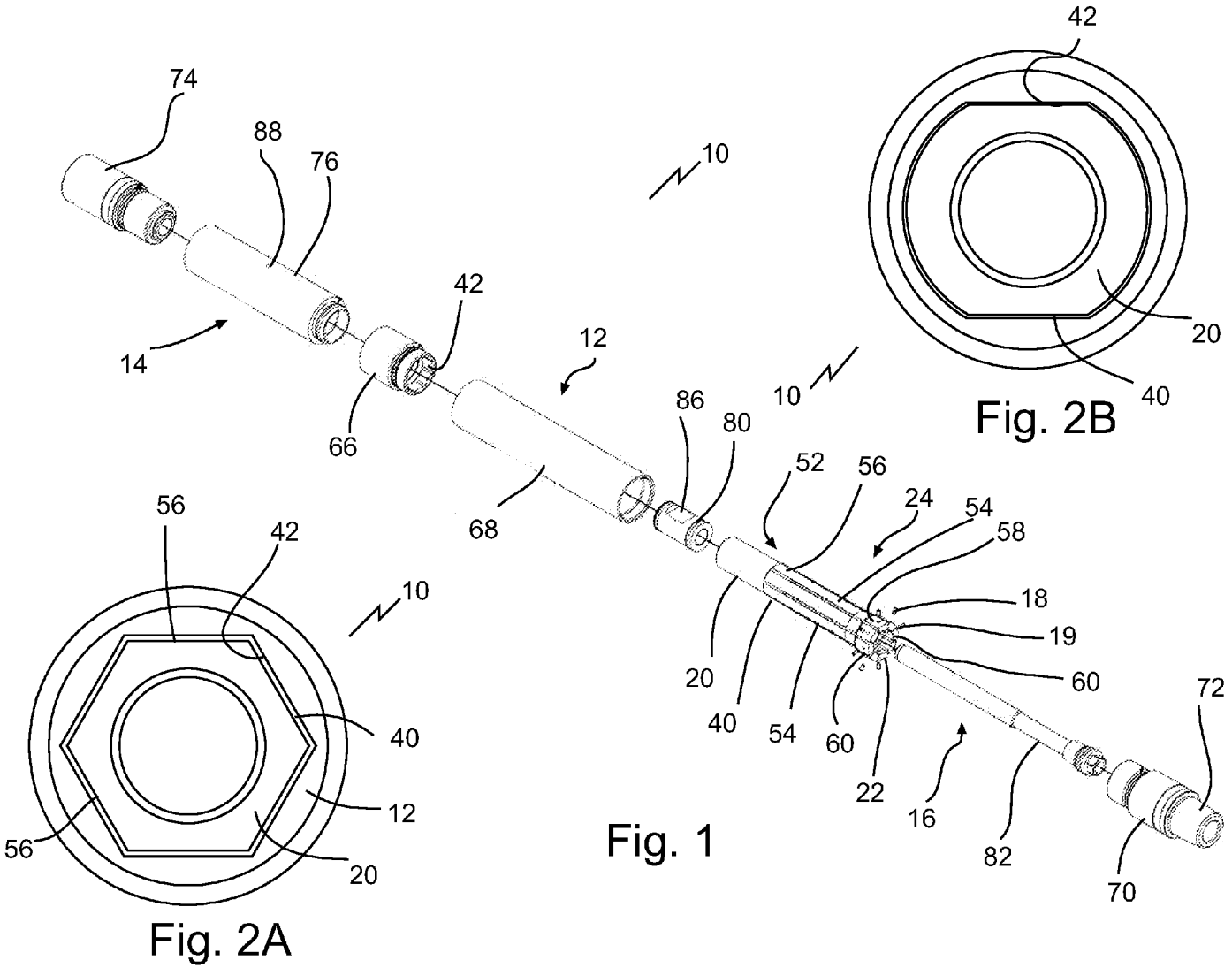
FIG. 1 is a perspective exploded view of a hydraulic disconnect.
FIG. 2A is a cross-sectional view taken along the section lines 2A-2A from FIG. 2.
FIG. 2B is a cross-section view taken on axis of another embodiment of a hydraulic disconnect.
Figure 2:
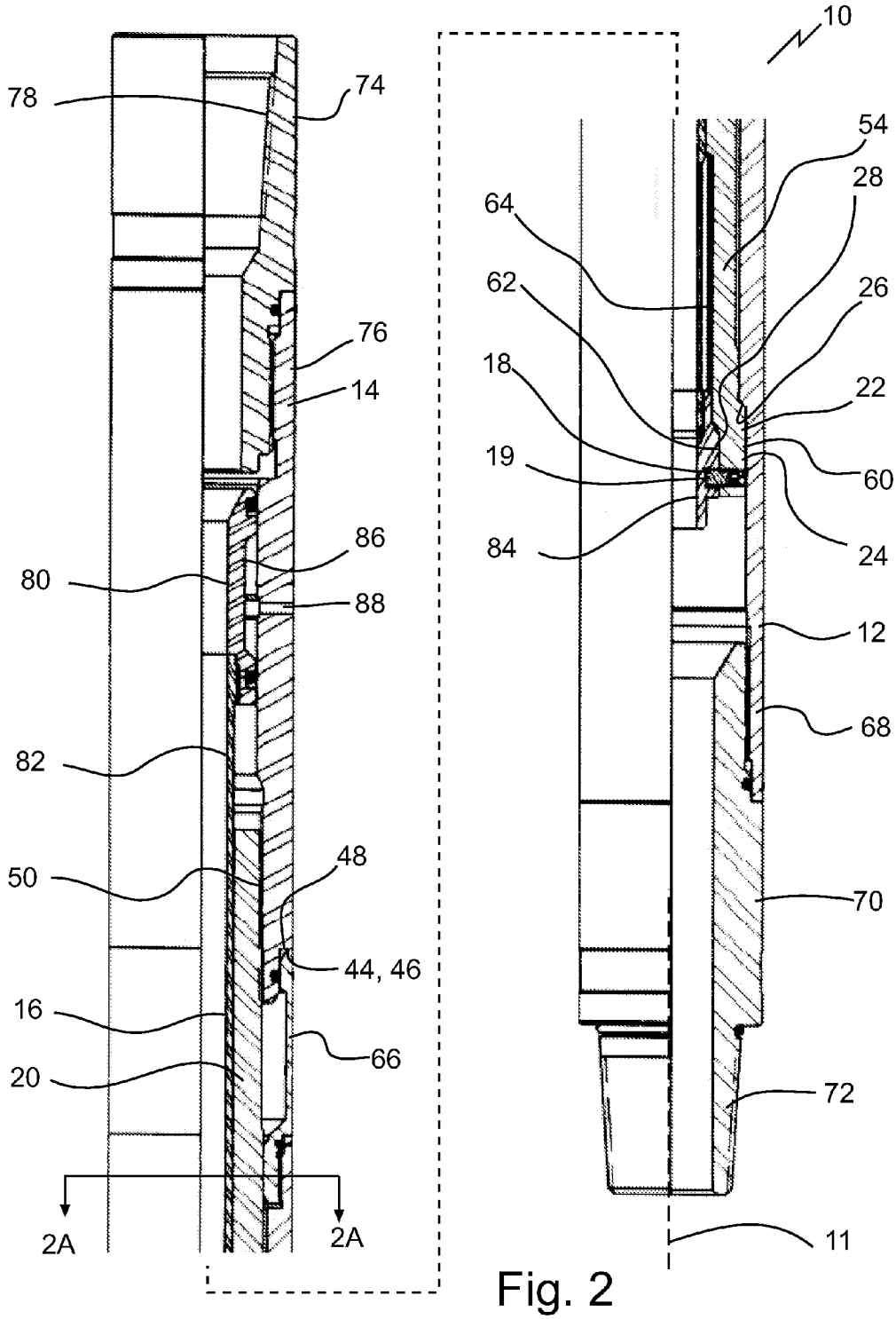
FIG. 2 is an exploded side elevation view, partially in section, of the hydraulic disconnect of FIG. 1

Referring to FIGS. 1 and 2, a hydraulic disconnect 10 is illustrated comprising a downhole housing 12, an uphole housing 14, a piston 16, a lock 18, and an inner mandrel 20. FIG. 1 illustrates the hydraulic disconnect 10 before assembly, while FIG. 2 illustrates the hydraulic disconnect 10 after assembly. Referring to FIG. 2, inner mandrel 20 is at least partially disposed telescopically within the downhole housing 12. Inner mandrel 20 has a latch 22, which may comprise a collet 24, that is extendable in a radially outward direction to latch against an inner shoulder 26 of the downhole housing 12. Radial directions discussed in this document refer to directions that are perpendicular to a tool axis 11 of the disconnect 10. Latch 22 supports tensile load in the string, while also indirectly connecting uphole housing 14 and downhole housing 12. Latch 22 allows inner mandrel 20 to restrict the downhole housing 12 from downhole movement relative to the inner mandrel 20.

Figure 4C:
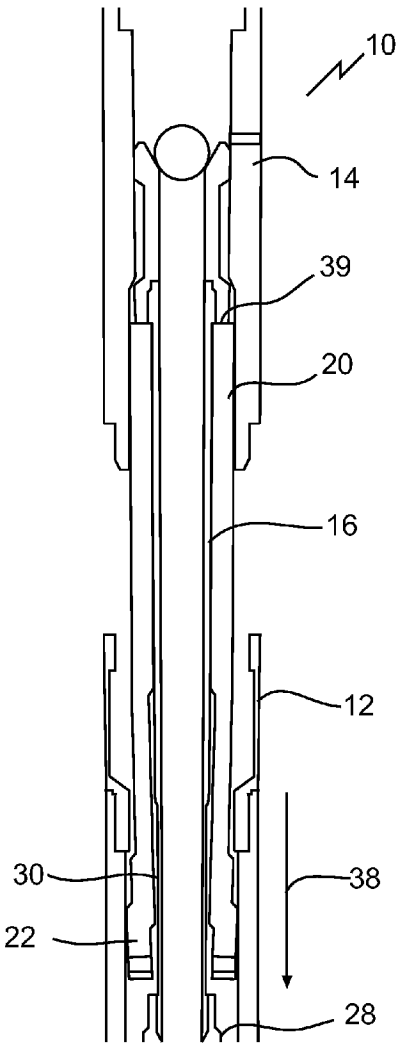
FIGS. 4A-C illustrate an unlatching sequence of an embodiment of a hydraulic disconnect.
Figure 4B:
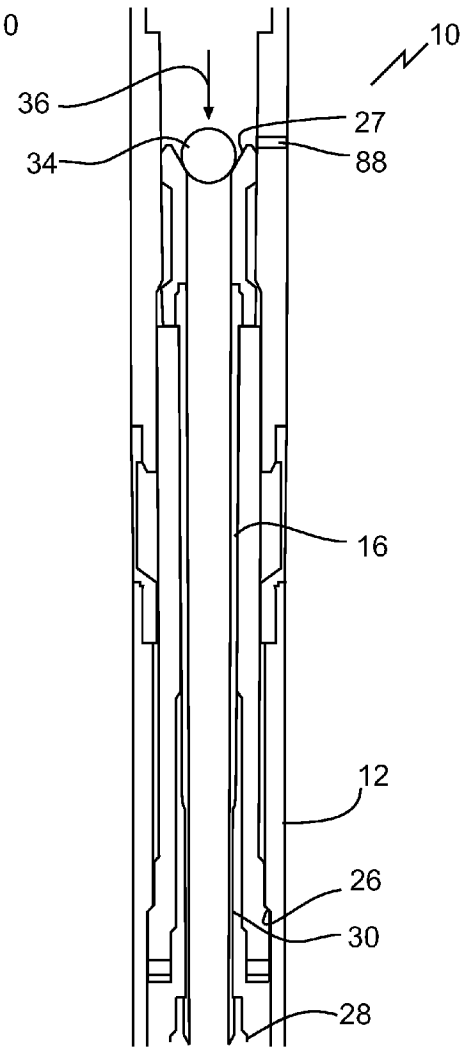
Figure 4A:
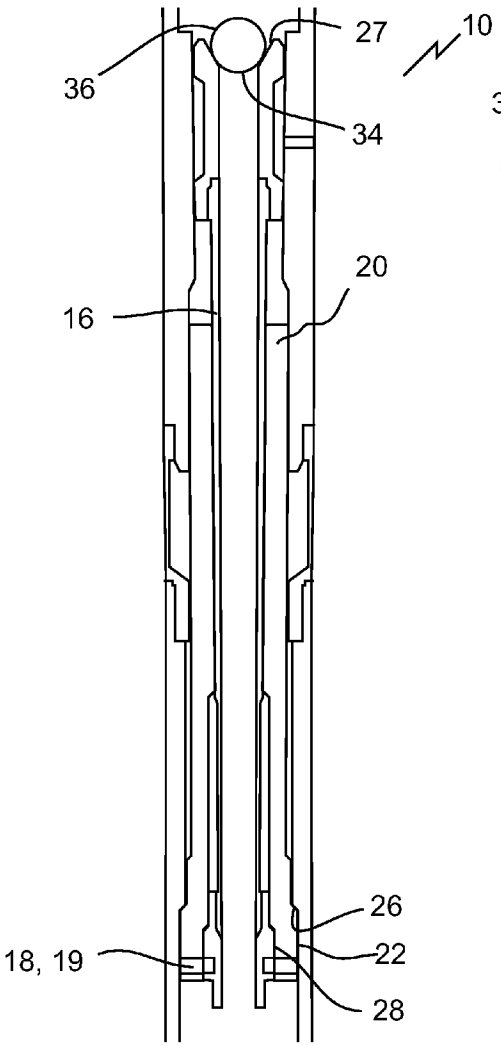

Referring to FIGS. 4A-C, piston 16 is at least partially disposed telescopically within the inner mandrel 20 and has a valve seat 27. Valve seat 27 may be an uphole facing seat as shown for receipt from uphole of a disconnect valve member 34 such as a ball 36. Ball 36 may be made of suitable material such as steel. Other shapes of valve members 34 may be used such as a bulbous plug (not shown). As shown, piston 16 has a latched position (FIG. 4A) and an unlatched position (FIGS. 4B-C). Lock 18, which may comprise one or more shear pins 19, maintains the piston 16 in the latched position (FIG. 4A). However, lock 18 is also adapted to unlock in use upon receipt by the valve seat 27 of disconnect valve member 34 and application of a predetermined hydraulic pressure (FIG. 4B). The pressure may be applied in a downhole direction 36 against the disconnect valve member 34 to allow the piston 16 to move into the unlatched position (FIG. 4B).

Referring to FIGS. 4A-C, the latched and unlatched positions of piston 16 are illustrated. In the latched position (FIG. 4A), an outer surface 28 of the piston 16 is positioned radially inward of the latch 22 to maintain latching against the inner shoulder 26. In the unlatched position (FIG. 4B) a groove 30 in the outer surface 28 is radially inward of the latch 22 to allow radial contraction of the latch 22 into the groove 30 (FIG. 4C) for release of the inner shoulder 26. Groove 30 is designed to be spaced from latch 22 a radial distance sufficient to allow latch 22 enough room to radially contract (FIG. 4C) for release of downhole housing 12. Radial contraction may occur for example upon application of a radially-inward force from inner shoulder 26 travelling in a downhole direction relative to latch 22. One or both of inner shoulder 26 and latch 22 may be tapered to allow transfer of axial movement of downhole housing 12 into radially inward force without locking the tool. FIG. 4C illustrates downhole housing 12 being released in a downhole direction 38 from the tubing string after unlatching. Once disconnect 10 is unlatched, disconnection may proceed upon application of a tensile force upon the tubing string. An inner shoulder 39 on hydraulic disconnect 10, for example on inner mandrel 20, may be positioned to prevent release of piston 16 with downhole housing 12. By retaining piston 16 with upper housing 14 after disconnect, fewer parts are needed to reassemble the tool for re-use in the event downhole housing 12 is not retrievable from the well.

Referring to FIGS. 1, 2, and 2A, inner mandrel 20 is connected for transmission of torque to the downhole housing 12. Relative telescopic movement may be allowed in some cases. When the motor in the bottom hole assembly is rotated, the hydraulic disconnect transmits torque to the lower tubing so that the drill bit will rotate with respect to the stationary tubing. During drilling, the bottom hole assembly torques up so that the drill bit will start to cut. When the drill actually cuts, the torque is momentarily released. The process may be repeated over and over during drilling. Because the cutting operation may not be even, these continuous cycles of cutting and releasing result in corresponding cycles of the application of torque followed by the release of the torque. A rugged torque transmission connection should be used to withstand such stresses.

In some embodiments of the hydraulic disconnects 10 disclosed herein, torque transmission is achieved by having the inner mandrel 20 and the downhole housing 12 comprise respective out of round convex cross-sectional profiles (illustrated as profiles 40 and 42, respectively, see FIG. 2A) that mesh in use for transmission of torque. Profiles 40 and 42 may be matching polygons, such as octagons as shown in FIG. 2A. Other shapes are possible, such as hexagons, nonagons, decagons, and others (not shown). A close tolerance fit may be used between profiles 40 and 42 to ensure efficient torque transfer with minimal wear. Regular and irregular polygonal profiles are possible, although regular polygons such as is shown in FIG. 2A have the advantage of ensuring a relatively thicker minimum wall thickness verses an irregular polygon of comparable size and having the same number of sides. Referring to FIG. 2B, the respective out-of-round convex cross-sectional profiles 40, 42 may be partly circular, for example in the shape of a truncated circle as shown. Profile 40 of inner mandrel 20 may be defined at the rigid origin 52 of a plurality of collet fingers 54 (FIG. 1). In further embodiments, each flat side 56 of profile 40 may extend into and become an outer surface 58 of a corresponding collet finger 54 (FIG. 1). Thus, machining of profile 40 and collet 24 may be integrated, reducing the cost of manufacturing disconnect 10. In addition, because profile 40 is defined on a rigid portion of inner mandrel 20 that is uphole of flexible collet fingers 54, torque transmission occurs through the rigid portion of the tool and not through the collet fingers 54, which are inherently weaker and prone to breakage.

Reference to the convexity of the cross-sectional profiles refers to the fact that a line drawn through the profile will not cross the profile more than twice. Such a requirement distinguishes profiles 40 and 42 from conventional torque transmission profiles such as splines or fingers, which define a concave closed path. The authors of this document have found that convex out of round profiles are less susceptible to damage and are easier to machine than splines, thus resulting in a more rugged and cost-effective tool. In addition, closed path profiles as disclosed herein are superior in the field for practical reasons like being easier to clean if dropped in dirt. The profiles 40, 42 need not be exact replicas of one another, so long as profiles 40, 42 match sufficiently to mesh. Thus, meshing need not occur across the entire respective profiles. Although embodiments with convex out of round profiles have the advantages discussed above, in some embodiments of disconnects 10 disclosed herein, torque may be transmitted through other profile shapes, such as splines.

Referring to FIG. 2, the uphole housing 14 may have a stop 44 such as a downhole facing shoulder 46 or end of housing 14, for restricting the downhole housing 12 from relative uphole movement. Shoulder 46 may be aligned to contact a corresponding uphole facing shoulder 48 on downhole housing 12 as shown. The inner mandrel 20 may be threaded to the uphole housing 14, for example through a threaded connection 50. The combination of threaded connection 50 and stop 44 allow relative rotation between the uphole housing 14 and the downhole housing 12 to tighten the downhole housing 12 between the latch 22 and the uphole housing 14. Tightening occurs because until downhole housing 12 is firmly held between latch 22 and stop 44, inner mandrel 20 may at least partially resist rotation with uphole housing 14 during thus acting to further make up threaded connection 50 until downhole housing 12 is pulled by latch 22 into contact with stop 44. Excess threading may be used to ensure that inner mandrel 20 can be tightened a sufficient distance for downhole housing 12 to contact stop 44. Upon tightening, torque from uphole housing 14 may be efficiently transferred to downhole housing 12 through inner mandrel 20. Inner mandrel 20 may initially resist rotation with uphole housing 14 in use because downhole housing 12, which is rotationally fixed with inner mandrel 20, may itself be frictionally held in place against initial rotation by connection to a drill bit sitting at the bottom of a well (not shown) for example. The inner mandrel 20 may be threaded into the uphole housing 14 with right hand threads (not shown), such that clockwise rotation of uphole housing 14 will tighten threaded connection 50. Tightening in use is advantageous because it compensates for loosely assembled disconnects 10, and also prevents disconnect 10 from vibrating apart in use. Although threaded connection 50 offers the advantages discussed above, inner mandrel 20 may in some embodiments be connected to uphole housing 14 through other means such as by integral construction with uphole housing 14.

Referring to FIGS. 1 and 2, collet 24 may terminate, for example through collet fingers 54, in one or more collet dogs 60. Dogs 60 may effectively form the latch 22 portion of the collet 24, and may be spaced radially about the axis of the disconnect tool 10. The outer surface 28 of the piston 16 may be shaped to fit within a groove 62, in an inner surface 64 of the collet 24, radially inward of the collet dogs 60 (FIG. 2). Thus, as shown in FIG. 2, the portion of outer surface 28 of piston 16 that sits within latch 22 while in the latched position may be provided with a relatively thicker cross-section that is more rigid and therefore less prone to radially inward flexing than otherwise. Shear pins 19 may be secured between the collet dogs 60 and the inner mandrel 20 (FIG. 2).

Referring to FIGS. 1 and 2, components discussed in this document such as uphole and downhole housings 14 and 12, inner mandrel 20, piston 16, and others may be individually composed of, for example, one or more units connected together. Each unit may be, for example, threaded together or secured by other suitable means. Downhole housing 12 is illustrated as being comprised of three components threaded together, namely a fishneck body 66, a lower release sub 68, and a bottom sub 70. Bottom sub 70 may comprise a pin 72 for connecting to a box (not shown) of a tubular positioned downhole of disconnect 10. Fishneck body 66 is sealably connected to uphole housing 14 as shown in FIG. 2, but not directly connected for transmission of torque. Thus, uphole housing 14 and downhole housing 12 may be axially separated during disconnect without having to unthread both components (FIG. 4C). Uphole housing 14 may comprise a top sub 74 threaded into an upper release sub 76. Upper release sub 76 may comprise a box 78 (FIG. 2) for connecting to a pin (not shown) of a tubular positioned uphole of disconnect 10. Piston 16 may comprise a release piston 80, a mandrel 82, and a support piston 84 threaded together. Release piston 80 may have a groove or bevel 86 (FIGS. 1 and 2) in the exterior surface. A port 88 (FIGS. 1 and 2) may be provided in uphole housing 14 for venting hydraulic pressure once release piston 80 has been pushed into the unlatched position (FIG. 4B). Thus, the operator is made aware that the tool has been unlatched by the subsequent pressure drop experienced as excess hydraulic fluid is vented through port 88. Other components may also form part of disconnect 10, such as o-rings or other sealing means as needed.

Figure 3:
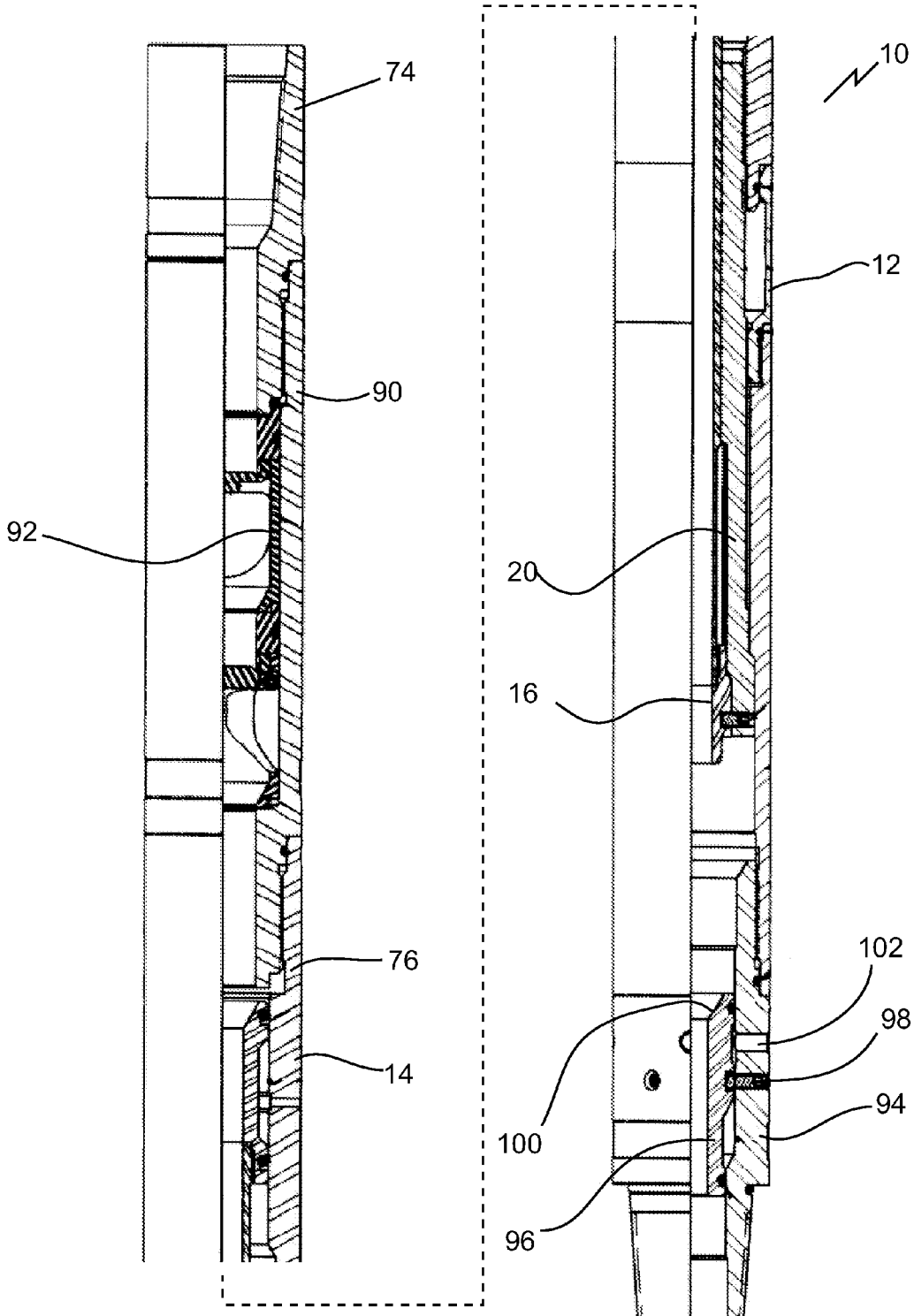
FIG. 3 is an exploded side elevation view, partially in section, of another embodiment of a hydraulic disconnect.

Referring to FIG. 3, another embodiment of a hydraulic disconnect 10 is illustrated. Modifications from the embodiment of FIG. 2 will now be discussed. Uphole housing 14 comprises a flapper body 90 between top sub 74 and upper release sub 76. Flapper body 90 comprises one or more flapper cartridges 92. Flapper body 90 may be provided as a check valve that has a spring-loaded plate (or flapper) that may be pumped through, generally in the downhole direction, but closes if the fluid attempts to flow back through the drillstring to the surface. This reverse flow might be encountered either due to a U-tube effect when the bulk density of the mud in the annulus is higher than that inside the drillpipe, or a well control event for example. Downhole housing 12 comprises a circulation sub 94 in place of the bottom sub 70 of FIG. 2. Circulation sub 94 comprises a circulation piston 96, a lock such as one or more shear screws 98, and a valve seat 100. Circulation sub 94 may be used with motors or assemblies that restrict the allowable fluid-circulation rates. When operated, the circulation sub 94 allows a higher circulation rate to be established by opening a path to the annulus in the top section of the tool string, for example through channel 102. Channel 102 may be exposed in fashion similar to the way that piston 16 may be moved to the unlatched position (see FIG. 4B). For example, a drop ball (not shown) may be received on valve seat 100 and hydraulic pressure applied to the drop ball to shear the shear screws 98 and bias circulation piston 96 downwardly. Use of a circulation sub may be advantageous in applications such as drilling in slim-diameter wells, where a higher circulation rate may be necessary to effect good cuttings transport and hole cleaning before the string is retrieved.

Housings 12 and 14, and other components of disconnect 10 may be tubulars. In a downhole application, one or both of uphole and downhole housing 14 and 12 may be connected, directly or indirectly, to a tubing string (not shown). Latch 22 may be annular in shape, although this is not required. Lugs (not shown) may be used in some cases instead of a collet 24. Grooves discussed herein may refer to portions of the relevant component that have different diameters relative to other portions of the same component or series of components. For example, a groove in an interior surface of a tubular may be a larger diameter section that the interior surface, and vice versa a groove in an exterior surface of a tubular may be a smaller diameter section than the exterior surface.

Hydraulic disconnects 10 of the type disclosed herein may be used in, for example, drilling, coiled tubing, and conventional threaded tubing, operations. The use of up, down, above, below, uphole, downhole, and directional language used in this document illustrates relative motions within disconnect 10, and are not intended to be limited to vertical motions or motions carried out while disconnect 10 is positioned downhole. It should be understood that disconnect 10 may be used in any type of well, including, for example, vertical and deviated wells.

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

What is claimed is:

1. A hydraulic disconnect comprising:

a downhole housing;

an uphole housing;

an inner mandrel at least partially disposed telescopically within the downhole housing, the inner mandrel having a latch extendable in a radially outward direction to latch against an inner shoulder of the downhole housing to restrict the downhole housing from relative downhole movement, the inner mandrel being connected for transmission of torque to the downhole housing;

a piston at least partially disposed telescopically within the inner mandrel and having a latched position in which an outer surface of the piston is radially inward of the latch to maintain latching against the inner shoulder, and an unlatched position in which a groove in the outer surface is radially inward of the latch to allow radial contraction of the latch into the groove for release of the inner shoulder, the piston having a valve seat; and a lock for maintaining the piston in the latched position, the lock being adapted to unlock in use upon receipt by the valve seat of a disconnect valve member and application of a predetermined hydraulic pressure in a downhole direction against the disconnect valve member to allow the piston to move into the unlatched position;

in which the uphole housing has a stop for restricting the downhole housing from relative uphole movement and the inner mandrel is threaded to the uphole housing such that relative rotation between the uphole housing and the downhole housing in use tightens the downhole housing between the latch and the uphole housing.

2. The hydraulic disconnect of claim 1 in which the latch comprises a collet.

3. The hydraulic disconnect of claim 2 in which the collet terminates in one or more collet dogs, and in which the outer surface of the piston is shaped to fit within a groove, in an inner surface of the collet, radially inward of the collet dogs.

4. The hydraulic disconnect of claim 2 in which the inner mandrel and the downhole housing comprise respective out of round convex cross-sectional profiles that mesh in use for transmission of torque.

5. The hydraulic disconnect of claim 4 in which the respective out of round convex cross-sectional profiles are matching polygons.

6. The hydraulic disconnect of claim 5 in which the matching polygons are octagons.

7. The hydraulic disconnect of claim 2 in which the lock comprises shear pins and the collet terminates in one or more collet dogs, and in which the shear pins are secured between the collet dogs and the inner mandrel.

8. The hydraulic disconnect of claim 1 in which the lock comprises one or more shear pins.

9. The hydraulic disconnect of claim 1 in which the disconnect valve member is a ball.

10. The hydraulic disconnect of claim 1 in which the inner mandrel is threaded to the uphole housing with right hand threads.

11. A hydraulic disconnect comprising:

a downhole housing;

an uphole housing having an inner mandrel;

the inner mandrel being at least partially disposed telescopically within the downhole housing, the inner mandrel having a latch extendable in a radially outward direction to latch against an inner shoulder of the downhole housing to restrict the downhole housing from relative downhole movement in use;

a piston at least partially disposed telescopically within the inner mandrel and having a latched position in which an outer surface of the piston is radially inward of the latch to maintain latching against the inner shoulder, and an unlatched position in which a groove in the outer surface is radially inward of the latch to allow radial contraction of the latch into the groove for release of the inner shoulder, the piston having a valve seat; and a lock for maintaining the piston in the latched position, the lock being adapted to unlock in use upon receipt by the valve seat of a disconnect valve member and application of a predetermined hydraulic pressure in a downhole direction against the disconnect valve member to allow the piston to move into the unlatched position;

in which the inner mandrel and the downhole housing comprise respective out-of-round convex cross-sectional profiles that mesh in use for transmission of torque.

12. The hydraulic disconnect of claim 11 in which the respective out-of-round cross-sectional profiles are matching polygons.

13. The hydraulic disconnect of claim 12 in which the matching polygons are octagons.

14. The hydraulic disconnect of claim 11 in which the respective out-of-round convex cross-sectional profiles are partly circular.

* * * * *